US007803745B2

(12) United States Patent
Kasai

(10) Patent No.: US 7,803,745 B2
(45) Date of Patent: Sep. 28, 2010

(54) LUBRICANT COMPOSITION

(75) Inventor: Moritsugu Kasai, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 669 days.

(21) Appl. No.: 11/658,144

(22) PCT Filed: Jul. 12, 2005

(86) PCT No.: PCT/JP2005/012849

§ 371 (c)(1),
(2), (4) Date: Jan. 23, 2007

(87) PCT Pub. No.: WO2006/009012

PCT Pub. Date: Jan. 26, 2006

(65) Prior Publication Data

US 2008/0096775 A1 Apr. 24, 2008

(30) Foreign Application Priority Data

Jul. 23, 2004 (JP) ..... 2004-215971

(51) Int. Cl.
*C10M 169/04* (2006.01)
*C10M 101/04* (2006.01)
*C10M 111/04* (2006.01)
*C10M 159/04* (2006.01)

(52) U.S. Cl. ..... 508/287; 508/486; 508/490

(58) Field of Classification Search ..... 508/287, 508/486, 490

See application file for complete search history.

(56) References Cited

U.S. PATENT DOCUMENTS

| | | | | |
|---|---|---|---|---|
| 5,241,003 | A * | 8/1993 | Degonia et al. | 525/123 |
| 5,858,931 | A * | 1/1999 | Tanaka et al. | 508/364 |
| 2002/0098993 | A1 * | 7/2002 | Ohsumi et al. | 508/579 |
| 2002/0119896 | A1 * | 8/2002 | Yagishita et al. | 508/291 |

FOREIGN PATENT DOCUMENTS

| | | |
|---|---|---|
| JP | 59-025890 | 2/1984 |
| JP | 9-53088 | 2/1997 |
| JP | 09-176668 | 7/1997 |
| JP | 2003-238982 | 8/2003 |
| JP | 2004-155891 | 6/2004 |
| JP | 2005-097570 | 4/2005 |
| JP | 2005-098495 | 4/2005 |
| WO | 2005/014763 | 2/2005 |

* cited by examiner

*Primary Examiner*—Walter D Griffin
*Assistant Examiner*—Frank C Campanell
(74) *Attorney, Agent, or Firm*—Oblon, Spivak, McClelland, Maier & Neustadt, L.L.P.

(57) ABSTRACT

A lubricating oil composition of the present invention which contains an ether ashless friction modifier is applicable to a sliding surface having a low friction sliding member, is capable of imparting excellent low friction characteristics thereto and, in particular, is capable of giving a fuel saving effect when applied to an internal combustion engine.

20 Claims, No Drawings

LUBRICANT COMPOSITION

TECHNICAL FIELD

The present invention relates to a lubricating oil composition which contains an ether ashless friction modifier, which is applicable to a sliding surface having a low friction sliding member and capable of imparting excellent low friction characteristics thereto and, in particular, which is capable of giving a fuel saving effect when applied to an internal combustion engine.

BACKGROUND ART

In recent years, global scale environmental problems such as the whole global warming and destruction of ozone layer have been greatly closed up. In particular, a reduction of carbon dioxide emission which has a great influence upon the whole global warming has been a great concern in many countries.

As regards the reduction of carbon dioxide emission, a reduction of fuel consumption of automobiles is mentioned as one of such problems. Accordingly, a sliding member and a lubricating oil play an important role.

The sliding member is required to be excellent in wear resistance and to show a low friction coefficient relative to a sliding part of an engine which is exposed to severe environment in friction and wear. A hard thin film material has been recently increasingly used for such purposes.

Meanwhile, a diamond-like carbon (DLC) material is expected to serve as a low friction sliding material because of its lower coefficient of friction in the air in the absence of a lubricating oil as compared with wear resisting hard coating material such as TiN and CrN.

On the other hand, as a measure for fuel saving in lubricating oil, suggested are (1) to reduce a viscosity resistance in a hydrodynamic lubrication region and a stirring resistance in an engine by lowering the viscosity thereof and (2) to decrease a friction loss in a boundary lubrication region by compounding an optimum friction modifier and various additives. As the friction modifier, many studies have been made chiefly on organic molybdenum compounds such as MoDTC and MoDTP. In a conventional sliding surface made of a steel material, a lubricating oil compounded with an organic Mo compound exhibiting an excellent low friction coefficient at an early stage after the start of use has been used and proven to be effective.

It is reported, however, that an ordinary DLC material which shows excellent low friction properties in the air gives only a low level of friction reducing effect, when used for a sliding part in the presence of a lubricating oil (see, for example, Non-Patent Document 1). It is also known that satisfactory effect of reducing friction is not obtainable, when a lubricating oil composition containing an organic molybdenum compound is applied to a sliding part provided with such a DLC material (see, for example, Non-Patent Document 2).

In this circumstance, a technique is disclosed in which a lubricating oil composition containing a fatty acid ester-type or an aliphatic amine-type, ashless friction modifier is applied to a sliding surface between a DLC member and an iron-based member or a DLC member and an aluminum alloy member (see, for example, Patent Document 1 and Patent Document 2).

Even when such a lubricating oil composition containing a fatty acid ester-type or an aliphatic amine-type, ashless friction modifier is applied to a sliding part having a DLC member, the low friction characteristics and fuel saving effect are merely comparative to those attained by an organic molybdenum compound-containing lubricating oil composition and are therefore not fully satisfactory.

[Patent Document 1] Japanese Unexamined Patent Application Publication No. 2003-238982

[Patent Document 2] Japanese Unexamined Patent Application Publication No. 2004-155891

[Non-Patent Document 1] Kano et al., "Japan Tribology Congress, Proceedings, Tokyo," May 1999, p 11-12

[Non-Patent Document 2] Kano et al., "World Tribology Congress," September 2001, Vienna, Proceedings, p 342

DISCLOSURE OF THE INVENTION

With the above circumstance in view, an object of the present invention is to provide a lubricating oil composition which is applicable to a sliding surface having a low friction sliding member, such as a DLC member, and capable of imparting excellent low friction characteristics thereto and, in particular, which is capable of giving a fuel saving effect when applied to an internal combustion engine.

The present inventors have made an earnest study with a view toward developing a lubricating oil composition having the above-described desired properties. As a result, it has been found that the object can be fulfilled by using an ether ashless friction modifier as a friction modifier.

The present invention has been completed on the basis of such a finding.

Thus, the present invention provides as follows:

(1) A lubricating oil composition for use with a low friction sliding member, comprising an ether ashless friction modifier.

(2) The lubricating oil composition as recited in item (1) above, wherein the ether ashless friction modifier is a (poly) glycerin ether compound represented by the general formula (I):

[Formula 1]

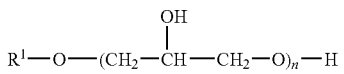

(I)

wherein $R^1$ represents a hydrocarbon group and n is an integer of 1 to 10.

(3) The lubricating oil composition as recited in the item (1) or (2) above, wherein an amount of the ether ashless friction modifier is 0.05 to 3% by mass based on a total mass of the composition.

(4) The lubricating oil composition as recited in the item (1), (2) or (3) above, further comprising a polybutenylsuccinimide and/or a derivative thereof in an amount of 0.1 to 15% by mass based on a total mass of the composition.

(5) The lubricating oil composition as recited in any one of the items (1) to (4) above, further comprising a zinc dithiophosphate in an amount of 0.01 to 0.20% by mass, in terms of phosphorus element, based on a total mass of the composition.

(6) The lubricating oil composition as recited in any one of the items (1) to (5) above, further comprising a phenol type antioxidant and/or an amine type antioxidant in an amount of 0.01 to 5% by mass based on a total mass of the composition.

(7) The lubricating oil composition as recited in any one of the items (1) to (6) above, wherein the low friction sliding member is a member having a diamond-like carbon film on a surface thereof.

(8) The lubricating oil composition as recited in the item (7) above, wherein the diamond-like carbon film comprises a hydrogen-free amorphous carbon-based material.

According to the present invention in which an ether ashless friction modifier is contained as a friction modifier, excellent low friction characteristics can be imparted to a sliding surface having a low friction sliding member, such as a DLC member, when applied thereto. In particular, the present invention provides a lubricating oil composition capable of giving a fuel saving effect to an internal combustion engine.

BEST MODE FOR CARRYING OUT THE INVENTION

The lubricating oil composition of the present invention contains an ether ashless friction modifier as a friction modifier and is applied to a low friction sliding member.

In the present invention, as the ether ashless friction modifier, there may be used a (poly)glycerin ether compound represented by the general formula (I):

[Formula 2]

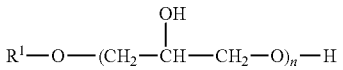

(I)

wherein $R^1$ represents a hydrocarbon group and n is an integer of 1 to 10.

As used herein the term "(poly)glycerin ether compound" is a shorthand term referring to glycerin ether or a polyglycerin ether.

As the hydrocarbon group represented by $R^1$ in the above general formula (I), there may be mentioned an alkyl group having 1 to 30 carbon atoms, an alkenyl group having 3 to 30 carbon atoms, an aryl group having 6 to 30 carbon atoms and an aralkyl group having 7 to 30 carbon atoms.

The alkyl group having 1 to 30 carbon atoms may be any of linear, branched or cyclic and specific examples thereof include methyl, ethyl, propyl, isopropyl, butyl, isobutyl, tert-butyl, pentyl, isopentyl, neopentyl, tert-pentyl, hexyl, heptyl, octyl, 2-ethylhexyl, nonyl, decyl, undecyl, dodecyl, tridecyl, isotridecyl, tetradecyl, hexadecyl, octadecyl, icocyl, dococyl, tetracocyl, triacontyl, 2-octyldodecyl, 2-dodecylhexadecyl, 2-tetradecyloctadecyl, 16-methylheptadecyl, cyclopentyl, cyclohexyl, methylcyclohexyl, and cyclooctyl groups.

The alkenyl group having 3 to 30 carbon atoms may be any of linear, branched or cyclic and specific examples thereof include allyl, propenyl, isopropenyl, butenyl, isobutenyl, pentenyl, isopentenyl, hexenyl, heptenyl, octenyl, nonenyl, decenyl, undecenyl, dodecenyl, tetradecenyl, oleyl, cyclopentenyl, cyclohexenyl, methylcyclopentenyl, and methylcyclohexenyl groups.

As the aryl group having 6 to 30 carbon atoms, there may be mentioned phenyl, naphthyl, tolyl, xylyl, cumenyl, mesityl, ethylphenyl, propylphenyl, butylphenyl, pentylphenyl, hexylphenyl, heptylphenyl, octylphenyl, and nonylphenyl groups.

As the aralkyl group having 7 to 30 carbon atoms, there may be mentioned benzyl, phenetyl, naphthylmethyl, benzhydryl, trityl, methylbenzyl, and methylphenethyl groups.

Of these groups, alkyl group and alkenyl groups having 8 to 20 carbon atoms are preferable from the standpoint of performance and easiness of availability of the (poly)glycerin ether compound.

In the above general formula (I), n represents a degree of polymerization of the (poly)glycerin and is an integer of 1 to 10, preferably an integer of 1 to 3 for exhibiting a high friction reducing effect.

Examples of the (poly)glycerin ether compound represented by the above general formula (I) include glycerin monododecyl ether, glycerin monotetradecyl ether, glycerin monohexadecyl ether (chimyl alcohol), glycerin monooctadecyl ether (batyl alcohol), glycerin monooleyl ether (selachyl alcohol), diglycerin monododecyl ether, diglycerin monotetradecyl ether, diglycerin monohexadecyl ether, diglycerin monooctadecyl ether, triglycerin monododecyl ether, triglycerin monotetradecyl ether, triglycerin monohesadecyl ether, and triglycerin monooctadecyl ether.

In the present invention, these (poly)glycerin ether compounds may be used singly or in combination of two or more thereof.

The amount of the (poly)glycerin ether compound is preferably in the range of 0.05 to 3% by mass, more preferably 0.1 to 2.0% by mass, particularly preferably 0.5 to 1.4% by mass, based on a total amount of the lubricating oil composition from the stand point of a balance between the friction reducing effect and economy.

A base oil used in the lubricating oil composition of the present invention is not specifically limited and may be suitably selected from conventionally employed mineral and synthetic base oils.

As the mineral oils, there may be mentioned, for example, distillate oils obtainable by atmospheric distillation of paraffin base crude oils, intermediate base crude oils or naphthene base crude oils or by vacuum distillation of residual oils from the atmospheric distillation, and refine oils obtainable by refining the above distillate oils in a conventional manner, such as solvent refined oils, hydrogenation refined oils, dewaxed oils and clay treated oils.

As the synthetic oil, there may be mentioned, for example, a poly(α-olefin) which is an olefin oligomer having 8 to 14 carbon atoms, polybutene, a polyol ester and an alkylbenzene.

In the present invention, the above mineral oils may be used singly or in combination of two or more thereof as the base oil.

The above synthetic oils may be used singly or in combination of two or more thereof.

Further, one or more mineral oils and one or more synthetic oils may be used in combination.

It is advantageous that the above base oil have a kinematic viscosity at 100° C. of generally 2 to 50 $mm^2/s$, preferably 3 to 30 $mm^2/s$, particularly preferably 3 to 15 $mm^2/s$.

When the kinematic viscosity at 100° C. is 2 $mm^2/s$ or more, a loss by evaporation is small. When the kinematic viscosity is 50 $mm^2/s$ or less, an energy loss due to viscosity resistance is reduced and the effect for improving the fuel consumption is well exerted.

Also, the base oil preferably has a viscosity index of at least 60, more preferably at least 70, particularly preferably at least 80.

When the viscosity index is at least 60, a change in viscosity of the base oil by a temperature change is small. Therefore, the base oil can show a stable lubrication performance.

It is preferred that the lubricating oil composition of the present invention contains a polybutenylsuccinimide and/or a derivative thereof.

As the polybutenylsuccinimide, there may be mentioned compounds represented by the general formula (II) or general formula (III):

[Formula 3]

(II)

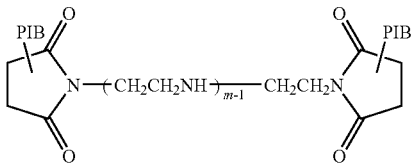

(III)

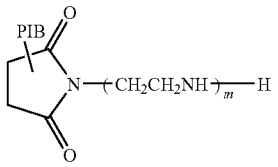

The symbol PIB in the above general formulas (II) and (III) represents a polybutenyl group derived from a polybutene which is obtained by polymerizing high purity isobutene or a mixture of 1-butene and isobutene by using a boron fluoride type catalyst or an aluminum chloride type catalyst and which has a number average molecular weight of generally 900 to 3,500, preferably 1,000 to 2,000.

When the number average molecular weight of the polybutene is 900 or more, a good cleaning effect is obtainable. When the number average molecular weight is 3,500 or less, a low temperature fluidity is good.

In the above general formulas (II) and (III), m is suitably an integer of 1 to 5, preferably an integer of 2 to 4 for reasons of good detergency.

The above-described polybutene is advantageously used after the removal of fluorine components and chlorine components, which are derived from the catalyst used during the manufacture thereof and which remain in a trace amount of, to generally 50 ppm or less, preferably 10 ppm or less, particularly preferably 1 ppm or less.

A method for producing the above polybutenylsuccinimide is not specifically limited. The polybutenylsuccinimide may be obtained by, for example, reacting butenylsuccinic acid, which is obtainable by reacting a chlorinated product of the above-mentioned polybutene or a polybutene from which chlorine and fluorine are sufficiently removed with maleic anhydride at about 100 to 200° C., with a polyamine such as diethylenetriamine, triethylenetetramine, tetraethylenepentamine or pentaethylenehexamine.

As the above-mentioned polybutenylsuccinimide derivative, there may be mentioned a so-called boron-modified compound or acid-modified compound obtained by reacting a compound represented by the above general formula (II) or (III) with a boron compound or an oxygen-containing organic compound to neutralize or amidize a part or whole of remaining amino groups and/or imino groups.

Typically, the use of a boron-containing polybutenylsuccinimide, particularly a boron-containing bispolybutenylsuccinimide is preferable.

As the above-described boron compound, there may be mentioned boric acid, boric acid salts and boric acid esters.

Specific examples of the boric acid include orthoboric acid and metaboric acid.

As the boric acid salt, there may be mentioned ammonium salts. Examples of suitable boric acid salts are ammonium borates such as ammonium metaborate, ammonium tetraborate, ammonium pentaborate and ammonium octaborate.

As the boric acid ester, there may be mentioned boric acid esters of a boric acid and an alkyl alcohol (preferably having 1 to 6 carbon atoms), suitable examples of which include monomethyl borate, dimethyl borate, triethyl borate, monoethyl borate, diethyl borate, triethyl borate, monopropyl borate, dipropyl borate, tripropyl borate, monobutyl borate, dibutyl borate and tributyl borate.

The boron-containing polybutenylsuccinimide generally has a mass ratio (B/N) of the boron content B thereof to the nitrogen content N thereof of 0.1 to 3, preferably 0.2 to 1.

Specific examples of the oxygen-containing compound include monocarboxylic acids having 1 to 30 carbon atoms such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid, and eicosanoic acid; polycarboxylic acids having 2 to 30 carbon atoms such as oxalic acid, phthalic acid, trimellitic acid, and pyromellitic acid; acid anhydrides thereof; esters thereof; alkylene oxides having 2 to 6 carbon atoms; and hydroxyl(poly)oxyalkylene carbonates.

In the lubricating oil composition of the present invention, the above-described polybutenylsuccinimides and derivatives thereof may be used singly or in combination of two or more thereof.

The polybutenylsuccinimides and derivatives thereof may be preferably present in an amount of 0.1 to 15% by mass, more preferably 1.0 to 12% by mass, from the standpoint of balance between the detergency effect, demulsification properties and economy.

It is preferred that the lubricating oil composition of the present invention contains a zinc dithiophosphate. As the zinc dithiophosphate, there may be used a dihydrocarbon zinc dithiophophate represented by the general formula (IV)

[Formula 4]

(IV)

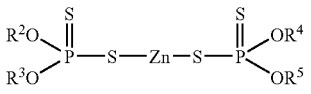

In the above general formula (IV), $R^2$ to $R^5$ each independently represent a hydrocarbon group.

As the hydrocarbon group, there may be mentioned an alkyl group having 1 to 24 carbon atoms, an alkenyl group having 3 to 24 carbon atoms, an aryl group having 6 to 24 carbon atoms and an aralkyl group having 7 to 24 carbon atoms.

The alkyl group having 1 to 24 carbon atoms may be any of linear, branched or cyclic, and specific examples thereof include methyl and ethyl groups; various propyl, butyl, pentyl, hexyl, heptyl, octyl, nonyl, decyl, decyl, undecyl, dodecyl, tridecyl, tetradecyl, pentadecyl, hexadecyl, heptadecyl, octadecyl, nonadecyl, icocyl, henicocyl dococyl, tricocyl and tetracocyl groups (inclusive of isomeric groups thereof); and cyclopentyl, cyclohexyl, cycloheptyl and alkyl-substituted groups thereof.

The alkenyl group having 3 to 24 carbon atoms may be any of linear, branched or cyclic and specific examples thereof include allyl, propenyl and isopropenyl groups; various butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icocenyl, henicocenyl, dococenyl, tricocenyl, and tetracocenyl groups (inclusive of isomeric groups thereof); and cyclopentenyl, cyclohexenyl, cycloheptenyl and alkyl-substituted groups thereof.

As the aryl group having 6 to 24 carbon atoms, there may be mentioned phenyl, naphthyl, tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl, and dodecylphenyl groups.

As the aralkyl group having 7 to 24 carbon atoms, there may be mentioned benzyl, methylbenzyl, dimethylbenzyl, phenetyl, methylphenethyl, dimethylphenethyl, and naphthylmethyl groups.

The dihydrocarbon zinc dithiophosphate represented by the above general formula (IV) is suitably a dialkyl zinc dithiophosphate, such as diisopropyl zinc dithiophosphate, diisobutyl zinc dithiophosphate, di-sec-butyl zinc dithiophosphate, di-sec-pentyl zinc dithiophosphate, di-n-hexyl zinc dithiophosphate, di-sec-hexyl zinc dithiophosphate, dioctyl zinc dithiophosphate, di-2-ethylhexyl zinc dithiophosphate, di-n-decyl zinc dithiophosphate, di-n-dodecyl zinc dithiophosphate or diisotridecyl zinc dithiophosphate. Above all, di-sec-alkyl zinc dithiophosphates are particularly preferable from the standpoint of improvement of wear resistance.

In the present invention, the above-described zinc dithiophosphates may be used singly or in combination of two or more thereof.

The amount of the zinc dithiophosphate is preferably in the range of 0.01 to 0.20% by mass, in terms of phosphorus element, based on a total amount of the composition.

When the amount is 0.01% by mass or more in terms of phosphorus element, suitable wear resistance and high temperature detergency properties may be obtained. When the amount is 0.2% by mass or less, catalyst poisoning of an exhaust gas catalyst can be suppressed.

The amount of the zinc dithiophosphate is more preferably 0.03 to 0.15% by mass, particularly preferably 0.06 to 0.10% by mass, in terms of phosphorus element.

The lubricating oil composition of the present invention can contain a phenol type antioxidant and/or an amine type antioxidant.

As the phenol-based antioxidant, there may be mentioned, for example, 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-cresol, 2,6-di-t-butyl-4-(N,N'-dimethylaminomethylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl)sulfide, bis(3,5-di-t-butyl-4-hydroxybenzyl) sulfide, n-octadecyl-3-(4-hydroxy-3,5-di-t-butylphenyl) propionate, and 2,2'-thio[diethyl-bis-3-(3,5-di-t-butyl-4-hydroxyphenyl)propionate]. Above all, bisphenol type and ester-containing phenol type antioxidants are preferable.

As the amine-based antioxidant, there may be mentioned, for example, monoalkyl diphenylamines such as monooctyldiphenylamines and monononyldiphenylamines; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyldiphenylamines such as tetrabutyldiphenylamine, tetrahexyldiphenylamine, tetraoctyldiphenylamine, tetranonyldiphenylamine; and naphthylaimes such as α-naphthylamine, phenyl-α-naphthylamine and alkyl-substituted phenyl-α-naphthylamines, e.g. butylphenyl-α-naphthylamine, pentylphenyl-α-naphthylamine, hexylphenyl-α-naphthylamine, heptylphenyl-α-naphthylamine, octylphenyl-α-naphthylamine, and nonylphenyl-α-naphthylamine. Above all, dialkyldiphenylamine type and naphthylamine type antioxidants are preferable.

In the present invention, the above-described phenol type and amine type antioxidants may be used singly or in combination of two or more thereof.

The antioxidant may be preferably present in an amount of 0.01 to 5% by mass, more preferably 0.2 to 3% by mass, from the standpoint of balance between the oxidation preventing effect and economy.

If necessary, other additives such as a metallic detergent, an anti-wear agent or an extreme pressure agent other than zinc dithiophosphate, other friction modifiers, other ashless dispersants, a viscosity index improver, a pour point depressant, a rust preventive agent, a surfactant or an demulsifying agent, a metal deactivator and a deforming agent, may be incorporated into the lubricating oil composition of the present invention in such an extent that the objects of the present invention are not adversely affected.

As the metallic detergent, any compound generally employed as a metallic detergent for lubricating oils may be used.

For example, alkali metal or alkaline earth metal sulfonates, phenates, salicylates and naphthenates may be used singly or in combination of a plurality thereof.

Examples of the alkali metal include sodium and potassium, and examples of the alkaline earth metal includes calcium and magnesium.

Concrete suitable examples of metallic detergents are Ca or Mg sulfonate, phenate and salicylate.

A total base number and an addition amount of the metallic detergent may be arbitrarily determined depending upon the desired performance of the lubricating oil composition.

Generally, the total base number is 0 to 500 mg KOH/g, preferably 50 to 400 mg KOH/g, as determined by the perchloric acid method. The addition amount is generally 0.1 to 10% by mass based on a total amount of the composition.

As the anti-wear agent or extreme pressure agent other than zinc dithiophosphate, there may be mentioned disulfides; sulfurized fats and oils; sulfurized olefins; phosphoric acid esters, thiophosphoric acid esters, phosphorus acid esters and thiophosphorous acid esters each has one to 3 hydrocarbon groups having 2 to 20 carbon atoms; and amine salts thereof.

As the other friction modifiers, there may be mentioned ashless friction modifiers such as fatty acid ester type, aliphatic amine type, boric acid ester type and higher alcohol type ashless friction modifiers; and metal type friction modifiers such as molybdenum dithiophosphate, molybdenum dithiocarbamate and molybdenum disulfide.

As the other ashless dispersants, there may be mentioned polybutenylbenzylamines and polybutenylamines each having a polybutenyl group with a number average molecular weight of 900 to 3,500, polybutenylsuccinimides having a polybutenyl group with a number average molecular weight of less than 900, and derivatives thereof.

Specific examples of the viscosity index improver include so called non-dispersion type viscosity index improvers such as copolymers of one or arbitral combinations of various methacrylates, and hydrogenated products thereof; and so called dispersion type viscosity index improvers obtainable by copolymerizing various methacrylates and containing nitrogen compounds.

Also, non-dispersion type or dispersion type ethylene-α-olefin copolymers (α-olefin may be, for example, propylene, 1-butene or 1-pentene) and hydrogenated products thereof; polyisobutylenes and hydrogenated products thereof; hydrogenated styrene-diene copolymers; styrene-maleate anhydride copolymers; and polyalkylstyrenes may be exemplified.

It is necessary that the molecular weight of the viscosity index improver should be selected in view of the shear stability thereof.

Specifically, for example, the number average molecular weight of the viscosity index improver is suitably 5,000 to 1,000,000, preferably 100,000 to 800,000, in the case the dispersion and non-dispersion type polymethacrylates, 800 to 5,000 in the case of the polyisobutylene or hydrogenated product thereof, and 800 to 300,000, preferably 10,000 to 200,000 in the case of the ethylene-α-olefin copolymer or hydrogenated product thereof.

The above viscosity index improvers can be used alone or in the form of a mixture of two or more thereof. The amount of the viscosity index improver is preferably 0.1 to 40.0% by mass based on the total amount of the lubricating oil composition.

The above viscosity index improvers may be used singly or in combination of two or more thereof. The amount of the viscosity index improver is generally 0.1 to 40.0% by mass based on the total amount of the lubricating oil composition.

As the pour point depressant, there may be mentioned, for example, polymethacrylate.

As the rust preventive agent, there may be mentioned alkylbenzene sulfonates, dinonylnaphthalene sulfonates of alkenylsuccinic acid esters, and polyhydric alcohol esters.

As the surfactant and demulsifying agent, there may be mentioned polyalkylene glycol type nonionic surfactants, such as polyoxyethylene alkyl ethers, polyoxyethylene alkylphenyl ethers and polyoxyethylene alkylnaphthyl ethers.

Further, as the metal deactivator, there may be mentioned imidazolines, pyrimidine derivatives, thiadiazole, benzotriazole and thiadiazole.

Further, as the deforming agent, there may be mentioned silicone oils, fluorosilicone oils and fluoroalkyl ethers.

The amount of the other friction modifier, the other ashless dispersant, the anti-wear agent or extreme pressure agent, the rust preventive agent and the surfactant or demulsifying agent is about 0.01 to 5% by mass based on the total amount of the lubricating oil composition, the amount of the metal deactivator is about 0.0005 to 1% by mass based on the total amount of the lubricating oil composition.

The lubricating oil composition of the present invention is applied to a sliding surface having a low friction sliding member and is able to impart excellent low friction characteristics thereto. In particular, the composition is capable of giving a fuel saving effect when applied to an internal combustion engine.

It is particularly preferred that the sliding surface having a low friction sliding member have one side provided with a DLC (diamond-like carbon) as the low friction sliding member.

In this case, the other member is not specifically limited. Thus, as the sliding surface, there may be mentioned, for example, a sliding surface between the DLC member and an iron base member and a sliding surface between the DLC member and an aluminum alloy member.

Here, the DLC member has a DLC film on a surface thereof. The DLC material constituting the film is composed mainly of carbon element and is amorphous. The carbon-carbon bonding has both a diamond structure ($SP^3$ bond) and a graphite bond ($Sp^2$ bond).

Specific examples of the DLC member include a-C (amorphous carbon) consisting only of carbon, hydrogen-containing a-C:H (hydrogen amorphous carbon), and MeC containing as its constituent a metal element such as titanium (Ti) or molybdenum (M). For reasons of a significant friction reducing effect, a member having a DLC film composed of a hydrogen-free a-C based material is preferably used for the purpose of the present invention.

As a constituent material of the iron base member, on the other hand, there may be mentioned carburized steel SCM420 and SCr420 (JIS).

As a constituent material of the aluminum alloy member, it is preferable to use a hypoeutectic aluminum alloy or hypereutectic aluminum alloy containing 4 to 20% by mass of silicon and 1.0 to 5.0% by mass of copper.

Specific examples of the aluminum alloy include AC2A, AC8A, ADC12 and ADC14 (JIS).

It is preferred that a surface roughness in the DLC member and the iron base member or in the DLC member and the aluminum alloy member be 0.1 μm or less in terms of an arithmetic mean roughness Ra from the standpoint of stable sliding therebetween.

When the surface roughness is less than 0.1 μm, a local scuffing is hardly formed and an increase of a friction coefficient can be prevented.

Further, the DLC member preferably has a surface hardness of Hv 1,000 to 3,500 in terms of micro Vickers hardness (98 mN load) and a thickness of 0.3 to 2.0 μm.

The iron base member, on the other hand, preferably has a surface hardness of HRC 45 to 60 in terms of Rockwell hardness (C scale).

In this case, it is possible to effectively maintain durability of the film even when it is exposed to sliding conditions under a high surface pressure of about 700 MPa as in the case of a cam follower member.

It is also preferred that the aluminum alloy member have a surface hardness of HB 80 to 130 in terms of a Brinell hardness.

When the surface hardness and the thickness of the DLC member are within the above-described ranges, friction and delamination may be suppressed.

When the surface hardness of the iron base member is HRC45 or greater, buckling and resulting delamination when subjected to a high surface pressure can be suppressed.

On the other hand, when the surface hardness of the aluminum alloy member is within the above-described range, wear of the aluminum alloy may be suppressed.

A sliding part to which the lubricating oil composition of the present invention is applied is not specifically limited as long as two metal surfaces are brought into contact with each other at that part and at least one of the two metal surfaces has a low friction sliding material. An example of suitable sliding part is a sliding part of an internal combustion engine.

In this case, significantly superior low friction characteristics as compared with the conventional composition can be obtained and fuel saving effect is significantly exerted.

As the DLC member, there may be mentioned, for example, a flat circular disc shim or lifter top surface in which DLC is coated on a base of a steel material. As the iron base member, there may be mentioned a cam lobe of a low alloy chilled cast iron, a carburized steel, a heat treated carbon steel or a material using any combination thereof.

EXAMPLE

The present invention will be next described in more detail with reference to examples. It should be noted, however, that these examples are not restrictive of the present invention.

Examples 1 to 3 and Comparative Examples 1 and 2

Lubricating oil compositions having the formulations shown in Table 1 were prepared and subjected to the friction characteristic test shown below to determine the coefficients of friction.

The results are shown in Table 1.

Friction Characteristic Test:

Friction characteristic tests were performed using a reciprocating friction tester (SRV tester).

As a test piece, used was a disc of a SUJ-2 material on which DLC was coated. Several drops of a sample oil (lubricating oil composition) were applied directly on the coating.

With a cylinder made of SUJ-2 set on the disc, a test was carried out under conditions involving a load of 400 N, an amplitude of 3 mm, a frequency of 50 Hz, and a temperature of 80° C. A coefficient of friction 30 minutes after the commencement was determined.

[Table 1]

TABLE 1

| | | Example | | | Comparative Example | |
|---|---|---|---|---|---|---|
| | | 1 | 2 | 3 | 1 | 2 |
| Lubricating Oil Composition (% by mass) | Lube base oil [1] | 86.80 | 87.00 | 86.30 | 86.70 | 86.80 |
| | Viscosity index improver | 6.00 | 6.00 | 6.00 | 6.00 | 6.00 |
| | Zinc dialkyldithiophosphate [2] | 1.10 | 0.90 | 1.10 | 1.10 | 1.10 |
| | Metallic detergent [3] | 1.60 | 1.60 | 1.60 | 1.60 | 1.60 |
| | Ashless dispersant [4] | 2.00 | 2.00 | 2.00 | 2.00 | 2.00 |
| | Ether friction modifier A [5] | 0.50 | 0.50 | — | — | — |
| | Ether friction modifier B [6] | — | — | 1.00 | — | — |
| | Organic molybdenum compound [7] | — | — | — | 0.60 | — |
| | Ester friction modifier [8] | — | — | — | — | 0.50 |
| | Other additives [9] | 2.00 | 2.00 | 2.00 | 2.00 | 2.00 |
| Coefficient of friction [80° C.] | | 0.070 | 0.065 | 0.068 | 0.075 | 0.085 |

Remarks:

[1] Paraffin mineral oil, kinematic viscosity at 100° C.: 4.7 $mm^2/s$

[2] Sec-alkyl type dialkyl zinc dithiophosphate, phosphorus content: 8.6% by mass

[3] Ca Sulfonate, Ca content: 12.5% by mass

[4] Polybutenylsuccinimide, nitrogen content: 1.0% by mass, no boron contained

[5] Glycerin monooctadecyl ether (batyl alcohol)

[6] Polyglycerin monooleyl ether (n = 1 to 3)

[7] Molybdenum dithiocarbamate

[8] Mixture of monoglycerol oleate and diglycerol oleate

[9] Viscosity index improver and antioxidant

The results shown in Table 1 indicates that the lubricating oil compositions of the present invention (Examples 1 to 3) have a low coefficient of friction and are excellent.

In contrast, the compositions of Comparative Examples 1 and 2 have a high coefficient of friction.

Comparative Example 1, in which molybdenum dithiocarbamate (organic molybdenum compound) is used as a friction modifier, has a problem that a low coefficient of friction cannot be maintained for a long period due to deterioration (depletion) of the compound itself.

The lubricating oil composition of the present invention is superior to the organic molybdenum compound with respect to maintenance of its low coefficient of friction.

INDUSTRIAL APPLICABILITY

The lubricating oil composition of the present invention is applicable to a sliding surface having a low friction sliding member, such as a DLC member, and capable of imparting excellent low friction characteristics thereto and, in particular, capable of giving a fuel saving effect when applied to an internal combustion engine.

The invention claimed is:

1. A method to lubricate a low friction sliding member, comprising:

applying to the low friction sliding member, a lubricating oil composition, comprising:

a base oil, and a (poly)glycerin ether compound represented by the general formula (I):

[formula 1]

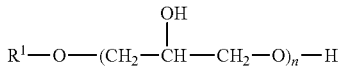

(I)

wherein $R^1$ represents a hydrocarbon group and n is an integer of 1 to 10, and wherein the low friction sliding member comprises a sliding surface which comprises diamond-like carbon.

2. The method to lubricate a low friction sliding member as defined in claim 1, wherein the lubricating oil composition is free of an organic molybdenum compound.

3. The method to lubricate a low friction sliding member as defined in claim 1, wherein an amount of the (poly)glycerin ether compound represented by the general formula (I) is 0.05 to 3% by mass based on a total mass of the composition.

4. The method to lubricate a low friction sliding member as defined in claim 1, wherein the lubricating oil composition further comprises a polybutenylsuccinimide and/or a derivative thereof in an amount of 0.1 to 15% by mass based on a total mass of the composition.

5. The method to lubricate a low friction sliding member as defined in claim 1, wherein the lubricating oil composition further comprises a zinc dithiophosphate in an amount of 0.01 to 0.20% by mass, in terms of phosphorus element, based on a total mass of the composition.

6. The method to lubricate a low friction sliding member as defined in claim 1, wherein the lubricating oil composition further comprises a phenol type antioxidant and/or an amine type antioxidant in an amount of 0.01 to 5% by mass based on a total mass of the composition.

7. The method to lubricate a low friction sliding member as defined in claim 1, wherein the low friction sliding member comprises a diamond-like carbon film on a surface thereof.

8. The method to lubricate a low friction sliding member as defined in claim 7, wherein the diamond-like carbon film comprises a hydrogen-free amorphous carbon-based material.

9. The method to lubricate a low friction sliding member as defined in claim 2, wherein the lubricating oil composition further comprises:

a polybutenylsuccinimide and/or a derivative thereof in an amount of 0.1 to 15% by mass, a zinc dithiophosphate in an amount of 0.01 to 0.20% by mass, in terms of phosphorus element, and a phenol type antioxidant and/or an amine type antioxidant in an amount of 0.01 to 5% by mass based on a total mass of the composition.

10. The method to lubricate a low friction sliding member as defined in claim 9, wherein an amount of the (poly)glycerin ether compound represented by the general formula (I) is 0.05 to 3% by mass based on the total mass of the composition.

11. The method to lubricate a low friction sliding member as defined in claim 1, wherein $R^1$ is an alkyl group having 8 to 20 carbon atoms or an alkenyl group having 8 to 20 carbon atoms.

12. The method to lubricate a low friction sliding member as defined in claim 1, wherein the base oil is a mineral base oil, synthetic base oil or mixture thereof, having a kinematic viscosity at 100° C. of from 2 to 50 $mm^2/s$.

13. The method to lubricate a low friction sliding member as defined in claim 1, wherein a viscosity index of the base oil is 60 or greater.

14. The method to lubricate a low friction sliding member as defined in claim 4, wherein the polybutenylsuccinimide and/or a derivative thereof is a compound selected from the group of compounds represented by formula (II) or Formula (III):

(II)

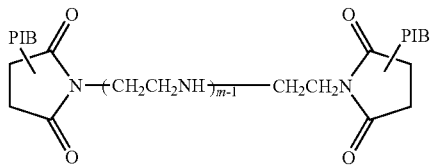

-continued (III)

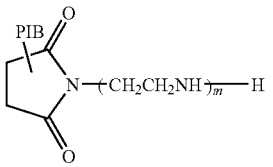

wherein PIB represents a polybutenyl group derived from a polybutene which is obtained by polymerizing high purity isobutene or a mixture of 1-butene and isobutene by using a boron fluoride type catalyst or an aluminum chloride type catalyst and which has a number average molecular weight of 900 to 3,500 and m is an integer of 1 to 5.

15. The method to lubricate a low friction sliding member as defined in claim 9, wherein the polybutenylsuccinimide and/or a derivative thereof is a compound selected from the group of compounds represented by formula (II) or Formula (III):

(II)

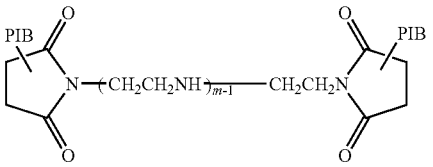

(III)

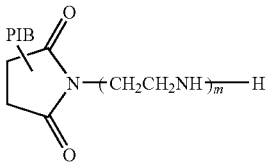

wherein PIB represents a polybutenyl group derived from a polybutene which is obtained by polymerizing high purity isobutene or a mixture of 1-butene and isobutene by using a boron fluoride type catalyst or an aluminum chloride type catalyst and which has a number average molecular weight of 900 to 3,500, and m is an integer of 1 to 5.

16. The method to lubricate a low friction sliding member as defined in claim 1, wherein the lubricating oil composition further comprises at least one additive selected from the group of additives consisting of a metallic detergent, an anti-wear agent, an extreme pressure agent other than zinc dithiophosphate, another friction modifier, another ashless dispersant, a viscosity index improver, a pour point depressant, a rust preventive agent, a surfactant, an demulsifying agent, a metal deactivator and a deforming agent.

17. The method to lubricate a low friction sliding member as defined in claim 9, wherein the lubricating oil composition further comprises at least one additive selected from the group of additives consisting of a metallic detergent, an anti-wear agent, an extreme pressure agent other than zinc dithiophosphate, another friction modifier, another ashless dispersant, a viscosity index improver, a pour point depressant, a rust preventive agent, a surfactant, an demulsifying agent, a metal deactivator and a deforming agent.

18. The method to lubricate a low friction sliding member as defined in claim 1, wherein the low friction sliding member comprising a sliding surface comprising diamond-like carbon is a sliding part of an internal combustion engine.

19. The method to lubricate a low friction sliding member as defined in claim 9, wherein the low friction sliding member comprising a sliding surface comprising diamond-like carbon is a sliding part of an internal combustion engine.

20. The method to lubricate a low friction sliding member as defined in claim 17, wherein the low friction sliding member comprising a sliding surface comprising diamond-like carbon is a sliding part of an internal combustion engine.

* * * * *